US006478898B1

(12) United States Patent
Sera et al.

(10) Patent No.: US 6,478,898 B1
(45) Date of Patent: Nov. 12, 2002

(54) METHOD OF PRODUCING TOOL STEELS

(75) Inventors: Tomoaki Sera, Nishinomiya; Masahide Umino; Yasutaka Okada, both of Nara; Kunio Kondo, Sanda, all of (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/664,766

(22) Filed: Sep. 19, 2000

(30) Foreign Application Priority Data

Sep. 22, 1999 (JP) ..... 11-268664
Sep. 22, 1999 (JP) ..... 11-269042
Feb. 3, 2000 (JP) ..... 2000-026056

(51) Int. Cl.[7] ..... C21D 11/00; C22C 38/00; C22C 38/40

(52) U.S. Cl. ..... 148/500; 148/622; 148/624; 148/663

(58) Field of Search ..... 148/500, 622, 148/624, 663

(56) References Cited

U.S. PATENT DOCUMENTS 3,366,471 A * 1/1968 Hill et al. ..... 148/503
5,458,703 A * 10/1995 Nakai ..... 148/503
5,645,794 A * 7/1997 Beguinot et al. ..... 420/106

FOREIGN PATENT DOCUMENTS

| | | |
|---|---|---|
| JP | 62067152 | 3/1987 |
| JP | 04358040 | 12/1992 |
| JP | 06256897 | 9/1994 |
| JP | 07102342 | 4/1995 |
| JP | 09217147 | 8/1997 |

* cited by examiner

*Primary Examiner*—Sikyin Ip
(74) *Attorney, Agent, or Firm*—Clark & Brody

(57) ABSTRACT

A method of producing a tool steel comprises quenching a steel containing, by mass percent, C: 0.25 to 0.60%, Si: 0.10 to 1.20%, Mn: 0.20 to 1.50%, Ni: 0.50 to 2.00%, Cr: 1.00 to 4.20%, Mo: 0.30 to 2.00%, V: 0.10 to 1.00% and Al: 0.005 to 0.10%, in order to obtain a hardness H such that the hardness index defined below by the formula (1) becomes between 0.20 to 0.95; and then tempering the steel;

$$K=(H-H2)/(H1-H2) \quad (1)$$

Where

H1: Vickers hardness of the steel with 10 mm thickness after heating to a temperature of the $A_{c3}$ transformation point plus 50° C., and quenching into water;

H2: Vickers hardness of the steel with 10 mm thickness after heating to the same temperature as defined above, and cooling to room temperature over 20 hours.

6 Claims, 3 Drawing Sheets

METHOD OF PRODUCING TOOL STEELS

This application claims priority under 35 U.S.C. §§119 and/or 365 to Japan Patent Application No.11-268664, No.11-269042 filed in Japan on Sep. 22, 1999 and No.2000-26056 filed in Japan on Feb. 3, 2000, the entire content of which is herein incorporated by reference.

BACKGROUND OF THE INVENTION

1. Field of the Invention

This invention relates to a method of producing a tool steel, which is intended for use in manufacturing tools such as hot forging dies, extrusion dies and die casting dies, and a method of manufacturing tools from the tool steel, and the tool steel itself.

2. Description of the Related Art

Train wheels, automobile crankshafts and the like are generally manufactured by a hot forging which comprises heating a mass of steel at about 1,300° C. and forging the steel into the product shape using dies. The technology of hot working includes, besides the above hot forging, a hot extrusion, by which steel bars and steel tubes are manufactured using dies. Among the dies used in hot working, there are dies used in casting aluminum alloys by the die casting method.

The tools such as the dies used in hot working processes undergo mechanical and thermal shocks at high temperatures. As a result, in addition to wear resulting from the friction between a die and a work in hot working, various cracks are formed on the tool such as the cracks, so-called heat checks, caused by a repetition of rapid heating and rapid cooling, the cracks caused by mechanical shocks, and the breaks resulting from the propagation of these cracks.

Therefore, a tool steel for hot working is required to have sufficient high temperature strength and fracture toughness rendering it resistant to wears, heat checks and breaks. The steel is also required to have good machinability so that the working time in tool manufactureing can be reduced and the life of the cutting tool to be used in manufacturing tools can be prolonged.

The tool steels in conventional use include alloy tool steels such as SKD61 and SKD62 based on the 5Cr—Mo—V steel, SKD7 based on the 3Cr—3Mo—V steel, and SKT3 and SKT4 based on the Ni—Cr—Mo—V steel, as defined in JIS G 4404. Under severe service conditions, however, these tool steels cannot meet such performance characteristics as mentioned above.

As a tool steel which can be used under such severe conditions, the applicant previously proposed a tool steel in JP Kokai H06-256897. The steel is characterized in that it contains, in percent by weight, C: 0.25 to 0.45%, Si: not more than 0.50%, Mn: 0.20 to 1.0%, P: not more than 0.015%, S: not more than 0.005%, Ni: 0.5 to 2.0%, Cr: 2.8 to 4.2%, Mo: 1.0 to 2.0% and V: 0.1 to 1%.

The chemical composition of this steel has been selected in order to obtain a martensite structure which is excellent in toughness and suitable for use in the form of dies. For its use as a tool, a method of obtaining dies has been disclosed which comprises the steps of oil quenching, tempering and working a steel into tool shapes.

The dies manufactured from the above tool steel have performance characteristics substantially satisfactory for use in hot forging dies and are quite applicable under ordinary hot forging conditions.

On the other hand, tool steels improved in machinability are disclosed in JP Kokai H04-358040 and JP Kokai H09-217147. The tool steel disclosed in JP Kokai H04-358040 is based on a technology of reducing the content of carbides which reduces machinability of the steel. However, a reduction of the carbide content results in reducing high temperature strength and therefore this tool steel has a drawback, for example the tool life is shortened.

The tool steel disclosed in JP Kokai H09-217147 reflects a technology of incorporating S and Te, which are alloy elements for enhancing machinability, into the steel as nonmetallic inclusions. In this technology, S and Te serve as a source of stress concentration in cutting work and thereby reduce the cutting force and increase the fracture facility of cutting tips, and thus attain an improvement of machinability. However, this tool steel has a disadvantage in that the nonmetallic inclusions of S and Te lead to a decrease in toughness and high temperature strength, although a certain extent of improvement in machinability can be noted.

SUMMARY OF THE INVENTION

It is an object of the present invention to provide a method of producing a tool steel, which is superior in high temperature strength and fracture toughness and in machinability to the conventional tool steels, and which can provide a prolonged tool life. A further object of this invention is to provide a method of manufacturing a tool from the tool steel and the tool steel itself.

The method of producing a tool steel according to the present invention comprises; preparing a steel having a chemical composition such that it contains, by mass percent, C: 0.25 to b %, Si: 0.10 to 1.20%, Mn: 0.20 to 1.50%, Ni: 0.50 to 2.00%, Cr: 1.00 to 4.20%, Mo: 0.30 to 2.00%, V: 0.10 to 1.00% and Al: 0.005 to 0.10%, with the balance being Fe and impurities, and further the content of P among the impurities is not more than 0.015%, that of S is not more than 0.005% and that of N is not more than 0.015%; quenching the steel to obtain a hardness H such that the hardness index K becomes between 0.20 to 0.95; and then tempering the steel.

The steel preferably has a chemical composition such that it contains, by mass percent, C: 0.25 to 0.45%, Si: 0.10 to 1.00%, Mn: 0.20 to 1.00%, Ni: 0.50 to 2.00%, Cr: 2.80 to 4.20%, Mo: 1.00 to 2.00%, V: 0.10 to 1.00% and Al: 0.005 to 0.10%, with the balance being Fe and impurities, among which the content of P is not more than 0.015%, that of S is not more than 0.005% and that of N is not more than 0.015%.

The steel also preferably has a chemical composition such that it contains, by mass percent, C: 0.40 to 0.60%, Si: more than 0.20% but not more than 1.20%, Mn: 0.20 to 1.50%, Ni: 1.00 to 2.00%, Cr: 1.00 to 2.70%, Mo: 0.30 to 2.00%, V: more than 0.10% but less than 0.80% and Al: not less than 0.005% but less than 0.10%, with the balance being Fe and impurities, among which the content of P is not more than 0.015%, that of S is not more than 0.005% and that of N is not more than 0.015%.

The method of manufacturing a tool according to the present invention comprises; preparing a steel having a chemical composition such that it contains, by mass percent, C: 0.25 to 0.60%, Si: 0.10 to 1.20%, Mn: 0.20 to 1.50%, Ni: 0.50 to 2.00%, Cr: 1.00 to 4.20%, Mo: 0.30 to 2.00%, V: 0.10 to 1.00% and Al: 0.005 to 0.10%, with the balance being Fe and impurities, and that the content of P among the impurities is not more than 0.015%, that of S not more than 0.005% and that of N not more than 0.015%; forming the steel into a tool shape; quenching the steel to obtain a hardness H such that the hardness index K becomes between 0.20 to 0.95; and then tempering the steel. The forming the steel into a tool shape may be carried out after tempering.

The steel for manufacturing a tool through the above-mentioned method preferably has a chemical composition such that it contains, by mass percent, C: 0.25 to 0.45%, Si: 0.10 to 1.00%, Mn: 0.20 to 1.00%, Ni: 0.50 to 2.00%, Cr: 2.80 to 4.20%, Mo: 1.00 to 2.00%, V: 0.10 to 1.00% and Al: 0.005 to 0.10%, with the balance being Fe and impurities, among which the content of P is not more than 0.015%, that of S is not more than 0.005% and that of N is not more than 0.015%.

The steel for manufacturing a tool through the above-mentioned method also preferably has a chemical composition such that it contains, by mass percent, C: 0.40 to 0.60%, Si: more than 0.20% but not more than 1.20%, Mn: 0.20 to 1.50%, Ni: 1.00 to 2.00%, Cr: 1.00 to 2.70%, Mo: 0.30 to 2.00%, V: more than 0.10% but less than 0.80% and Al: not less than 0.005% but less than 0.10%, with the balance being Fe and impurities, among which the content of P is not more than 0.015%, that of S is not more than 0.005% and that of N is not more than 0.015%.

The tool steel according to the present invention has a chemical composition such that it contains, by mass percent, C: 0.40 to 0.60%, Si: more than 0.20 but not more than 1.20%, Mn: 0.20 to 1.50%, Ni: 1.00 to 2.00%, Cr: 1.00 to 2.70%, Mo: 0.30 to 2.00%, V: more than 0.10 but less than 0.80% and Al: not less than 0.005 but less than 0.10%, with the balance being Fe and impurities, and further the content of P among the impurities is not more than 0.015%, that of S is not more than 0.005% and that of N is not more than 0.015%; and has a hardness H such that the hardness index K is between 0.20 to 0.95.

The hardness index K referred to hereinabove is defined by the following equation (1):

$$K=(H-H2)/(H1-H2) \quad (1)$$

where

H1: Vickers hardness found on a standard sample with 10 mm thickness which is heated to a temperature of the $A_{c3}$ transformation point plus 50° C., and quenched into water;

H2: Vickers hardness found on a standard sample with 10 mm thickness which is heated to a temperature of the $A_{c3}$ transformation point plus 50° C., and cooled slowly to room temperature over 20 hours.

The term "quench" as used herein includes all treatments of cooling from the austenite zone.

DETAILED DESCRIPTION

The present inventors made investigations on tool steels while paying attention to the relation between the hardness of steels after cooling from a temperature in the austenite zone and its characteristics. They further investigated the relation between the content of Si, which is regarded as being effective in improving the machinability of tool steels, and its characteristics. As a result, they obtained the findings mentioned below and have now completed the present invention based on the findings.

Figure 1:
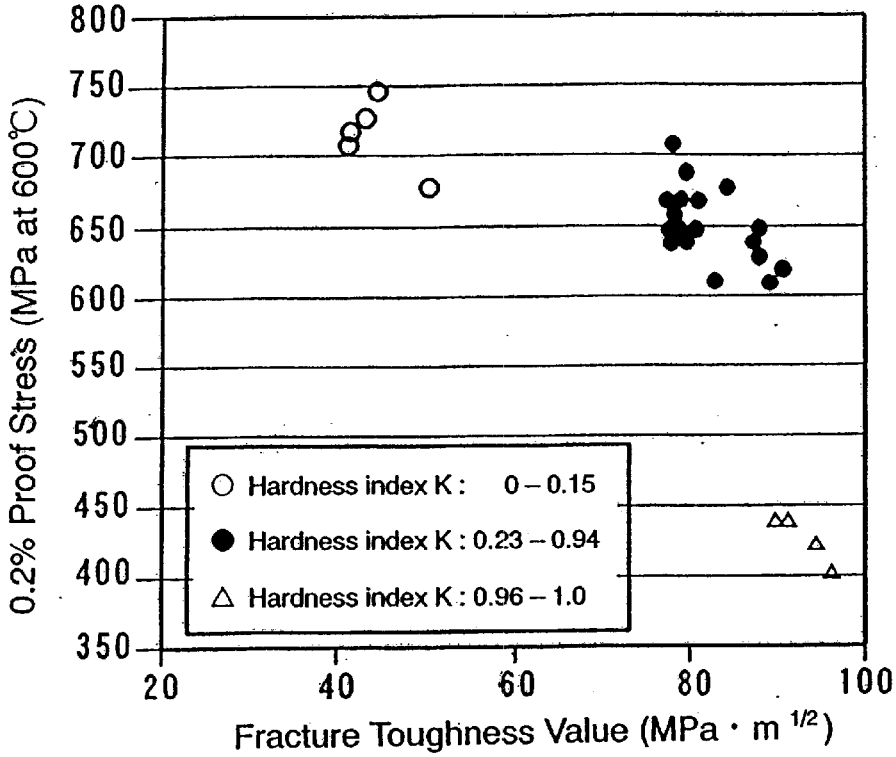
FIG. 1 is a graph showing the relationship between the fracture toughness and high temperature strength (0.2% proof stress at 600° C.) after quenching and tempering for the various hardness index K after quenching.

FIG. 1 is a graph showing the relationship between the fracture toughness and high temperature strength after quenching and tempering for the various hardness index K after quenching, as obtained by the tests Nos. 1 to 29 in the examples mentioned later herein. As is seen from the figure, when the hardness index K after quenching is not more than 0.15, the high temperature strength after quenching is high but the fracture toughness is very low. When the hardness index K after quenching is not less than 0.96, the fracture toughness is high but the high temperature strength is very low. On the other hand, when the hardness index K after quenching is 0.23 to 0.94, the high temperature strength and fracture toughness are both high.

As for the reason therefor, the dependency on the form of carbide precipitated during tempering from the bainite phase and martensite phase after quenching is presumable. Thus, by selecting an appropriate bainite phase amount in the state after quenching, it is possible to obtain a steel excellent in high temperature strength and fracture toughness after tempering. This bainite phase amount after tempering is closely related with the hardness, and the above-mentioned proper hardness index range of 0.23 to 0.94 can be regarded as corresponding to a proper range of the bainite phase amount.

Figure 2:
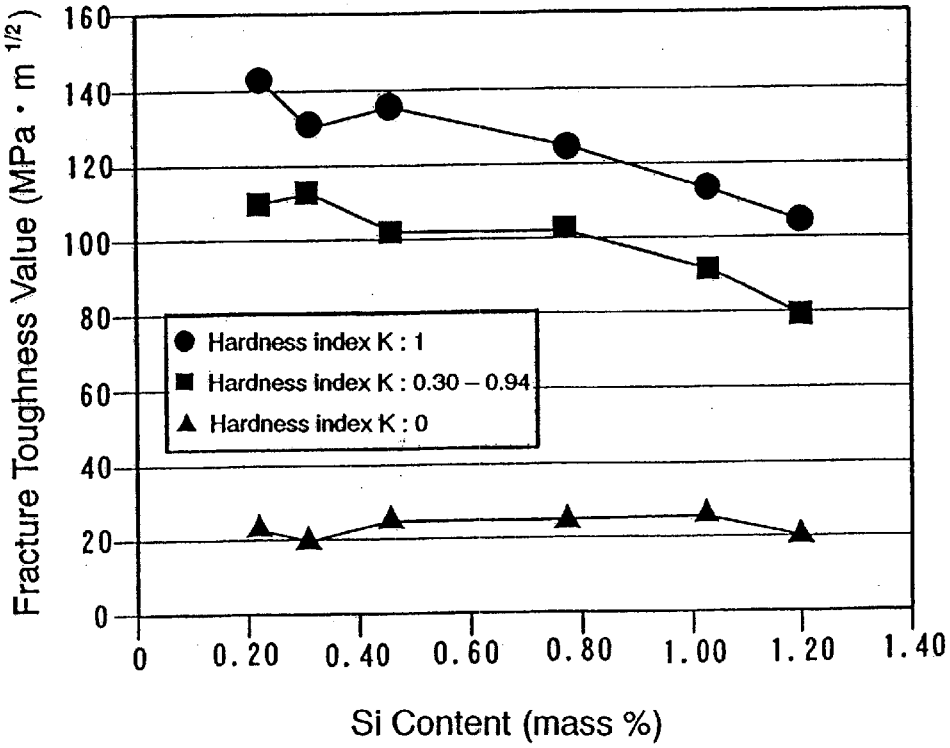
FIG. 2 is a graph showing the relationship between the Si content and the fracture toughness after quenching and tempering for the various hardness index K after quenching.

FIG. 2 is a graph showing the relationship between the Si content and the fracture toughness after quenching and tempering for the various hardness index K after quenching, as obtained by the tests Nos. 101 to 118 in the examples to be mentioned later herein. As is evident from the figure, when the hardness index after quenching is equal to 1, a smaller Si content tends to give a higher fracture toughness value. And, by adjusting the Si content to 1.20% by mass or below, it is possible to obtain a fracture toughness value of not less than 77.5 $MPa \cdot m^{1/2}$, which is requisite to tool steels.

When the hardness index K after quenching is 0.30 to 0.94, lower fracture toughness values result as compared with the case where the hardness index K is 1. The influence of the Si content on the fracture toughness value is smaller as compared with the case of the hardness index K being 1. However, even in this case, it is possible to obtained a fracture toughness value of not less than 77.5 $MPa \cdot m^{1/2}$, which is requisite to tool steels, by selecting an Si content of not more than 1.20% by mass.

When the hardness index K after quenching is 0, the fracture toughness value becomes lowest and a fracture toughness value of not less than 77.5 $MPa \cdot m^{1/2}$, which is requisite to tool steels, can never be obtained at any Si content level. The Si content does not influence on the fracture toughness value at all.

Figure 3:
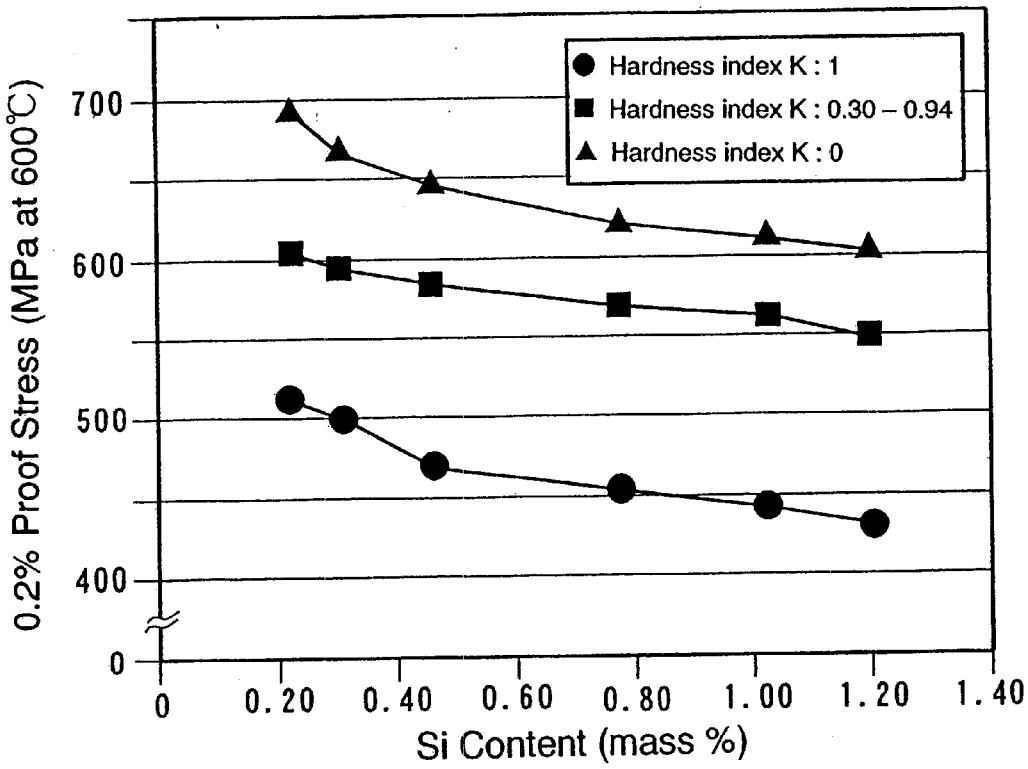
FIG. 3 is a graph showing the relationship between the Si content and the high temperature strength (0.2% proof stress at 600° C.) after quenching and tempering for the various hardness index K after quenching.

FIG. 3 is a graph showing the relationship between the Si content and high temperature strength for the various hardness index K after quenching, as obtained in the tests Nos. 101 to 118 in the examples to be mentioned later herein. As is seen from the figure, the high temperature strength decreases with the increase in Si content.

The high temperature strength is lowest when the hardness index K after quenching is 1. When the hardness index K after quenching is 0.30 to 0.94 and when the hardness index K is 0, the high temperature strength increases in that order.

Figure 4:
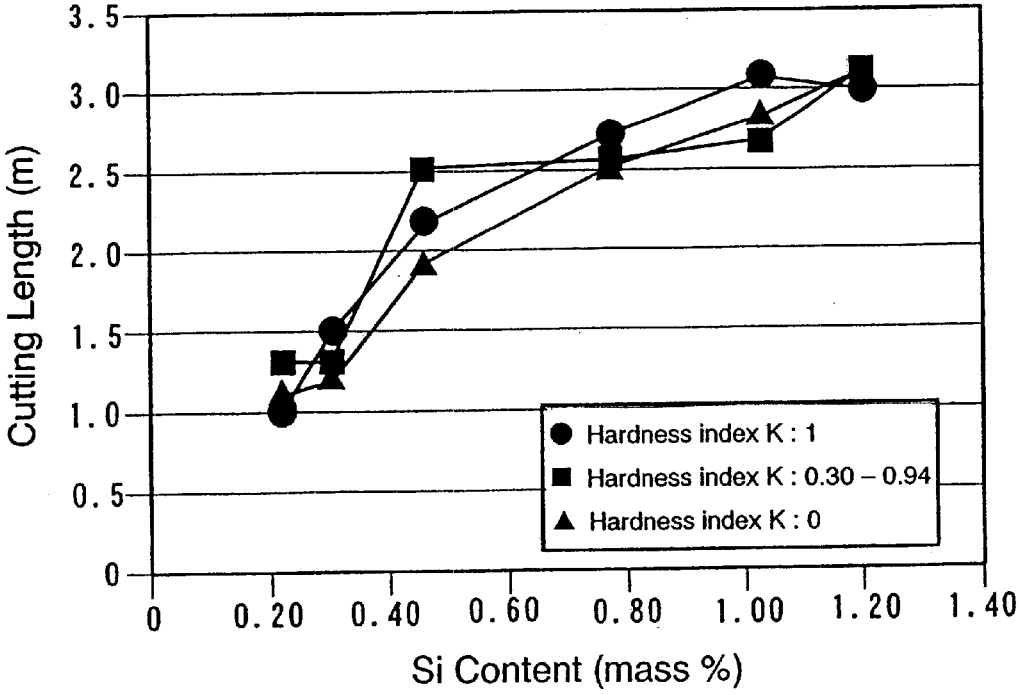
FIG. 4 is a graph showing the relationship between the Si content and machinability (cutting length throughout cutting tool life) for the various hardness index K after quenching.

FIG. 4 is a graph showing the relationship between the Si content and machinability for the various hardness index K after quenching, as obtained in the tests Nos. 101 to 118 in the examples to be mentioned later herein. As can be seen from the figure, the machinability does not depend on the hardness index K after quenching but increases with the increase in Si content at any level of hardness index K. And, when the Si content is in excess of 0.20% by mass, the level of machinability, when expressed in terms of cutting length, can amount to not less than 1 m, which is required to tool steels.

As mentioned above, to increase the Si content is effective in improving machinability but, on the other hand, results not only in decreasing fracture toughness values but also in reducing high temperature strength. However, when the Si content is increased, the fracture toughness and high temperature strength can be prevented from decreasing if the hardness index K after quenching is maintained within the range of 0.30 to 0.94.

In particular, in case of the steel with the chemical composition defined in the present invention, it is further possible to cause precipitation of fine carbides in the step of tempering and, therefore, the high temperature strength can be inhibited from decreasing even when the hardness index K is rather high. When, however, the hardness index K exceeds 0.95, the amount of fine carbides precipitated in the bainite phase is too small to produce an improving effect on the high temperature strength. On the other hand, when the hardness index K is smaller than 0.20, the precipitation amount of fine carbides increases but the precipitation amount of large carbides also increases, presumably leading to failure to obtain a sufficient improving effect in fracture toughness.

In the following, the chemical composition and hardness index K after quenching of the tool steel according to the present invention are illustrated. In the following description, the contents of alloying elements in the chemical composition are expressed in terms of percent by mass.

C

C is effective in improving the hardenability and toughness of steel and is secondarily precipitated as carbides and nitrides in the step of tempering to thereby improve the high temperature strength. However, when its content is less than 0.25%, its effects are poor. At a content exceeding 0.60%, a decrease in machinability is caused. Therefore, the content of C is selected within the range of 0.25 to 0.60%. When the Cr content is high and its lower limit is 2.80%, the upper limit to the C content is preferably set at 0.45% since the Cr carbide readily becomes concentrated. The C content of 0.30 to 0.40% is more preferred. When the Cr content is low and its upper limit is 2.70%, the lower limit of the C content is preferably set at 0.40% so that the hardenability can be secured.

Si

Si is effective in improving the machinability of steel. However, when its content is less than 0.10%, the effect of its addition is poor. When its content is in excess of 1.20%, it causes decreases in toughness and high temperature strength and thus shortens the life of tools. Therefore, the content of Si should be within the range of 0.10 to 1.20%. When the Cr content is high and its lower limit is 2.80%, the upper limit of the Si content is preferably set at 1.00% and an Si content of 0.20 to 0.50% is more preferred. When the Cr content is low and its upper limit is 2.70%, the lower limit of the Si content is preferably set at a level higher than 0.20%.

Mn

Mn is an element effective in increasing the hardenability and toughness of steel. However, at a level lower than 0.20%, its addition can hardly produce its effects. At a level exceeding 1.50%, segregation of Mn may occur in steel, leading to decreases in toughness and strength. Hence, the content of Mn should be 0.20 to 1.50%. When the Cr content is high and its lower limit is set at 2.80%, the upper limit of the Mn level is preferably set at 1.00%. A more preferred Mn content is 0.50 to 0.80%. When the Cr content is low and its upper limit is set at 2.70%, the Mn content is preferably 0.50 to 1.00%.

Ni

Ni also is an element effective in increasing the hardenability and toughness. However, at a level lower than 0.50%, it produces only poor effects. At a level exceeding 2.00%, it lowers the transformation point, whereby the high temperature strength is diminished. Thus, the Ni content is selected within the range of 0.50 to 2.00%. When the Cr content is high and its lower limit is set at 2.80%, the Ni content is preferably 0.80 to 1.70%. When the Cr content is low and its upper limit is set at 2.70%, the lower limit to the Ni content is preferably set at 1.00%.

Cr

Cr is an element effective in improving the toughness and wear resistance. However, at a level lower than 1.00%, it cannot produce satisfactory effects. At a level exceeding 4.20%, it causes a decrease in high temperature strength. Therefore, the Cr content should be 1.00 to 4.20%. In particular, in cases where wear resistance is required, for example in the case of press dies, the lower limit is preferably set at 2.80%. For use in manufacturing hammer dies, for instance, which are especially required to be tough, the upper limit is preferably set at 2.70%.

Mo

Mo improves the hardenability and resistance to softening of steel and increases the toughness and high temperature strength. However, at a level lower than 0.30%, its addition remains ineffective. At a level exceeding 2.00%, it causes decreases in machinability and toughness. Hence, the Mo content should be 0.30 to 2.00%. When the Cr content is high and its lower limit is set at 2.80%, the lower limit of the Mo content is preferably set at 1.00%. A more preferred Mo content is 1.30 to 1.70%.

V

V is an element necessary for increasing the high temperature strength. At a level less than 0.10%, however, its effect is poor. At a level exceeding 1.00%, the toughness is reduced. Therefore, the V content should be 0.10 to 1.00%. When the Cr content is high and the upper limit thereto is set at 2.80%, a V content exceeding 0.60% results in decreased machinability, hence the upper limit of the V content is preferably set at 0.60%, more preferably at 0.50%. When the Cr content is low with the upper limit at 2.70%, the V content is preferably more than 0.10% but less than 0.80%.

Al

Al is an element effectively serving to deoxidize and homogenize steel. At a level lower than 0.005%, however, the intended effects cannot be obtained. Conversely, at a level exceeding 0.10%, the machinability decreases and/or the amount of nonmetallic inclusions increases. Hence, the Al content should be 0.005 to 0.10%. When the Cr content is high with the lower limit being set at 2.80%, the upper limit of the Al content is preferably set at 0.06%. When the Cr content is low with the upper limit being set at 2.70%, the upper limit of the Al content is preferably set at 0.10%.

In the tool steel according to the present invention, the contents of the impurities P, S and N are restricted as follows:

P

P shows a tendency toward segregation in steel, causing a decrease in toughness and/or thermal cracking, hence it is desired that its content is as low as possible. The P content thus should be not higher than 0.015%.

S

S forms sulfides and thus lowers the toughness, hence it is desired that its content is as low as possible. The P content thus should be not higher than 0.005%.

N

N is high in affinity for V and readily forms nitrides with it, leading to a decrease in the level of dissolved V. If the amount of dissolved V is small, the amount of the carbide and nitride of V as secondarily precipitated in the step of tempering decreases and the high temperature strength decreases accordingly. When the V content is low, these influences are significant. The N content thus should be not higher than 0.015%.

Hardness Index K

When the hardness index K after quenching is less than 0.20, the toughness after tempering becomes low. When, conversely, the hardness index K exceeds 0.95, the decrease in high temperature strength after tempering is remarkable. Thus, the hardness index K should be in the range of 0.20 to 0.95. When the Cr content is high with the lower limit being set at 2.80%, the hardness index K is preferably in the range of 0.4 to 0.6. When the Cr content is low with the upper limit being set at 2.70%, the hardness index K is preferably in the range of 0.4 to 0.7.

The hardness index K is defined by the formula (1) shown below where H1 is the hardness found on the standard sample with 10 mm thickness which is heated to a temperature higher by 50° C. than the $A_{c3}$ transformation point and quenched into water, H2 is the hardness found on the same sample which is heated in the same manner and cooled slowly to room temperature over 20 hours, and H is the hardness of the steel after quenching.

Each hardness is expressed in terms of Vickers hardness measured with a test force of 98 N.

$$K=(H-H2)/(H1-H2) \quad (1)$$

In this description, the standard sample means a 10 mm thick piece of the steel and the temperature means the surface temperature of the steel.

The above tool steel is produced by preparing a mass of steel having the chemical composition defined above by melting in an electric furnace, converter or the like and then subjecting it to hot working such as rolling or forging, annealing, quenching and tempering.

The quenching is effected by heating to an austenite zone temperature, for example 900 to 1,050° C., followed by water cooling, oil cooling or allowing to cool, so as to attain a hardness such that the hardness index K may become 0.20 to 0.95. The hardness H such that the hardness index K value becomes 0.20 to 0.95 can be obtained by determining the relation between cooling conditions and hardness index K in advance and selecting appropriate cooling conditions from among those found useful. The steel is further tempered at 550 to 640° C. after quenching.

The tool according to the invention is manufactured by producing the steel having the chemical composition mentioned above by melting in an electric furnace, converter or the like, further subjecting the steel to hot working, such as rolling or forging, and annealing, and shaping the steel to a tool by, for example, machining, electric-discharge machining, and then quenching and tempering.

The quenching is effected by heating to an austenite zone temperature, for example 900 to 1,050° C., and water cooling, oil cooling or allowing to cool, to a hardness such that the hardness index K defined by the above formula (1) become 0.20 to 0.95.

The step of tool shaping by machining or electric-discharge machining may also be carried out after quenching and tempering.

EMBODIMENTS

EXAMPLE 1

The steels having the chemical compositions specified in Table 1 and Table 2 were melted in an electric furnace and each steel ingot obtained was hot rolled by a blooming mill, then forged to a mass of steel with a forging ratio of 5, which was then annealed at 800–850° C. In Table 2, No. 52 is the alloy tool steel SKT4 defined in JIS G 4404 and No. 53 is the alloy tool steel SKD61 defined in JIS G 4404.

Thereafter, for varying the hardness index K after quenching, blanks (samples) having a thickness of 10 to 800 mm were prepared. Among these, each 10 mm standard sample was heated to a temperature higher by 50° C. than the $A_{c3}$ transformation point and then subjected to water quenching or slow cooling to room temperature over 20 hours. Other blanks were cooled with water or oil or allowed to cool from 900–1,050° C. for obtaining varied hardness values. Thereafter, the standard sample and other blanks were measured for Vickers hardness (testing force 98 N) and the hardness index values K were calculated. The results are shown in Table 1 and Table 2, together with the $A_{c3}$ transformation points.

TABLE 1

| | | Chemical composition (% by weight) Balance: Fe and impurities | | | | | | | | | | | $A_{c3}$ Transformation | |
|---|---|---|---|---|---|---|---|---|---|---|---|---|---|---|
| Example | No. | C | Si | Mn | Ni | Cr | Mo | V | Al | N | P | S | point (° C.) | Hardness index K |
| This | 1 | 0.25 | 0.21 | 0.75 | 1.74 | 2.91 | 1.89 | 0.15 | 0.014 | 0.008 | 0.002 | 0.001 | 840 | 0.78 |
| Invention | 2 | 0.44 | 0.47 | 0.67 | 1.50 | 2.93 | 1.53 | 0.24 | 0.015 | 0.010 | 0.004 | 0.001 | 838 | 0.75 |
| | 3 | 0.39 | 0.31 | 0.60 | 1.88 | 3.03 | 1.20 | 0.21 | 0.015 | 0.009 | 0.003 | 0.002 | 818 | 0.47 |
| | 4 | 0.41 | 0.21 | 0.55 | 1.62 | 3.13 | 1.40 | 0.44 | 0.014 | 0.008 | 0.002 | 0.002 | 821 | 0.88 |
| | 5 | 0.39 | 0.39 | 0.79 | 1.51 | 2.85 | 1.54 | 0.34 | 0.014 | 0.008 | 0.002 | 0.003 | 844 | 0.77 |
| | 6 | 0.39 | 0.22 | 0.72 | 1.41 | 2.86 | 1.88 | 0.29 | 0.015 | 0.010 | 0.003 | 0.003 | 831 | 0.80 |
| | 7 | 0.39 | 0.32 | 0.61 | 1.41 | 3.06 | 1.50 | 0.25 | 0.016 | 0.008 | 0.004 | 0.001 | 833 | 0.78 |
| | 8 | 0.38 | 0.40 | 0.69 | 1.27 | 2.91 | 1.16 | 0.44 | 0.016 | 0.010 | 0.003 | 0.002 | 851 | 0.75 |

TABLE 1-continued

| Example | No. | Chemical composition (% by weight) Balance: Fe and impurities | | | | | | | | | | | $A_{c3}$ Transformation point (° C.) | Hardness index K |
|---|---|---|---|---|---|---|---|---|---|---|---|---|---|---|
| | | C | Si | Mn | Ni | Cr | Mo | V | Al | N | P | S | | |
| | 9 | 0.37 | 0.40 | 0.79 | 1.52 | 2.92 | 1.41 | 0.41 | 0.014 | 0.009 | 0.003 | 0.001 | 849 | 0.80 |
| | 10 | 0.41 | 0.35 | 0.69 | 1.28 | 2.93 | 1.84 | 0.35 | 0.016 | 0.009 | 0.003 | 0.002 | 844 | 0.78 |
| | 11 | 0.42 | 0.29 | 0.52 | 1.47 | 2.94 | 1.48 | 0.15 | 0.016 | 0.010 | 0.003 | 0.003 | 819 | 0.47 |
| | 12 | 0.42 | 0.32 | 0.68 | 1.33 | 2.95 | 1.49 | 0.37 | 0.015 | 0.009 | 0.002 | 0.002 | 836 | 0.94 |
| | 13 | 0.45 | 0.11 | 0.23 | 1.98 | 2.83 | 1.03 | 0.11 | 0.016 | 0.008 | 0.001 | 0.001 | 777 | 0.23 |
| | 14 | 0.40 | 0.21 | 0.64 | 1.51 | 3.00 | 1.52 | 0.16 | 0.016 | 0.009 | 0.002 | 0.001 | 816 | 0.88 |
| | 15 | 0.39 | 0.35 | 0.67 | 1.39 | 2.85 | 1.42 | 0.21 | 0.016 | 0.012 | 0.002 | 0.001 | 835 | 0.79 |
| | 16 | 0.41 | 0.46 | 0.72 | 1.67 | 3.09 | 1.12 | 0.52 | 0.015 | 0.009 | 0.003 | 0.002 | 846 | 0.80 |
| | 17 | 0.42 | 0.39 | 0.62 | 1.22 | 3.03 | 1.14 | 0.68 | 0.015 | 0.013 | 0.002 | 0.002 | 853 | 0.78 |
| | 18 | 0.41 | 0.39 | 0.73 | 1.41 | 3.08 | 1.52 | 0.72 | 0.014 | 0.012 | 0.001 | 0.003 | 859 | 0.77 |
| | 19 | 0.41 | 0.50 | 0.63 | 1.24 | 2.93 | 1.31 | 0.83 | 0.016 | 0.008 | 0.002 | 0.003 | 872 | 0.76 |
| | 20 | 0.40 | 0.43 | 0.62 | 1.77 | 3.07 | 1.61 | 0.98 | 0.015 | 0.011 | 0.002 | 0.002 | 864 | 0.76 |
| For | 21 | 0.43 | 0.45 | 0.74 | 1.82 | 4.01 | 1.89 | 0.20 | 0.015 | 0.009 | 0.003 | 0.003 | 834 | 0.99 |
| comparison | 22 | 0.42 | 0.40 | 0.68 | 1.29 | 2.98 | 1.50 | 0.30 | 0.016 | 0.014 | 0.002 | 0.001 | 841 | 1.00 |
| | 23 | 0.39 | 0.41 | 0.71 | 1.46 | 2.88 | 1.89 | 0.21 | 0.015 | 0.013 | 0.001 | 0.002 | 850 | 0.97 |
| | 24 | 0.40 | 0.35 | 0.71 | 1.27 | 3.06 | 1.80 | 0.36 | 0.015 | 0.010 | 0.002 | 0.003 | 846 | 0.96 |
| | 25 | 0.39 | 0.32 | 0.67 | 1.77 | 3.09 | 1.71 | 0.30 | 0.015 | 0.010 | 0.002 | 0.001 | 830 | 0.15 |
| | 26 | 0.43 | 0.35 | 0.76 | 1.77 | 2.94 | 1.14 | 0.16 | 0.014 | 0.014 | 0.004 | 0.002 | 817 | 0.11 |
| | 27 | 0.41 | 0.42 | 0.77 | 1.45 | 3.11 | 1.74 | 0.20 | 0.016 | 0.010 | 0.003 | 0.001 | 841 | 0.10 |
| | 28 | 0.43 | 0.40 | 0.64 | 1.76 | 3.13 | 1.24 | 0.31 | 0.014 | 0.013 | 0.001 | 0.001 | 827 | 0 |
| | 29 | 0.41 | 0.32 | 0.66 | 1.31 | 2.92 | 1.31 | 0.42 | 0.015 | 0.010 | 0.001 | 0.001 | 838 | 0.05 |
| | 30 | 0.23 | 0.40 | 0.63 | 1.52 | 2.85 | 1.37 | 0.34 | 0.014 | 0.009 | 0.003 | 0.001 | 866 | 0.77 |

TABLE 2

| Example | No. | Chemical composition (% by weight) Balance: Fe and impurities | | | | | | | | | | | $A_{c3}$ Transformation point (° C.) | Hardness index K |
|---|---|---|---|---|---|---|---|---|---|---|---|---|---|---|
| | | C | Si | Mn | Ni | Cr | Mo | V | Al | N | P | S | | |
| For | 31 | 0.39 | 1.89 | 0.63 | 1.59 | 2.90 | 1.28 | 0.17 | 0.016 | 0.013 | 0.001 | 0.002 | 909 | 0.76 |
| comparison | 32 | 0.40 | 0.53 | 0.05 | 1.37 | 2.97 | 1.38 | 0.32 | 0.016 | 0.009 | 0.002 | 0.002 | 846 | 0.79 |
| | 33 | 0.39 | 0.37 | 2.01 | 1.30 | 2.95 | 1.46 | 0.34 | 0.014 | 0.013 | 0.002 | 0.002 | 863 | 0.79 |
| | 34 | 0.39 | 0.38 | 0.72 | 0.10 | 2.96 | 1.39 | 0.29 | 0.015 | 0.008 | 0.002 | 0.001 | 869 | 0.80 |
| | 35 | 0.37 | 0.45 | 0.78 | 2.97 | 2.92 | 1.70 | 0.35 | 0.014 | 0.014 | 0.004 | 0.003 | 823 | 0.79 |
| | 36 | 0.39 | 0.40 | 0.63 | 1.51 | 5.55 | 1.15 | 0.33 | 0.015 | 0.012 | 0.003 | 0.002 | 840 | 0.79 |
| | 37 | 0.39 | 0.49 | 0.66 | 1.40 | 3.08 | 0.07 | 0.31 | 0.014 | 0.011 | 0.001 | 0.002 | 838 | 0.77 |
| | 38 | 0.40 | 0.43 | 0.71 | 1.58 | 3.10 | 2.73 | 0.31 | 0.014 | 0.012 | 0.003 | 0.002 | 854 | 0.77 |
| | 39 | 0.27 | 0.47 | 0.74 | 1.01 | 3.06 | 1.61 | 0.01 | 0.015 | 0.012 | 0.003 | 0.001 | 868 | 0.75 |
| | 40 | 0.40 | 0.45 | 0.74 | 1.72 | 2.87 | 1.78 | 1.23 | 0.016 | 0.013 | 0.004 | 0.001 | 880 | 0.77 |
| | 41 | 0.38 | 0.45 | 0.75 | 1.24 | 2.94 | 1.64 | 0.45 | 0.016 | 0.012 | 0.003 | 0.003 | 862 | 1.00 |
| | 42 | 0.38 | 0.32 | 0.78 | 1.73 | 2.87 | 1.55 | 0.42 | 0.115 | 0.020 | 0.004 | 0.002 | 837 | 0.76 |
| | 43 | 0.40 | 0.31 | 0.75 | 1.63 | 3.13 | 1.12 | 0.28 | 0.015 | 0.014 | 0.051 | 0.010 | 826 | 0.79 |
| | 44 | 0.23 | 0.36 | 0.67 | 2.13 | 3.04 | 1.14 | 0.41 | 0.016 | 0.009 | 0.002 | 0.002 | 850 | 0.76 |
| | 45 | 0.41 | 1.32 | 0.72 | 1.45 | 2.99 | 1.80 | 0.03 | 0.014 | 0.014 | 0.017 | 0.001 | 917 | 0.78 |
| | 46 | 0.52 | 0.46 | 0.13 | 1.35 | 2.98 | 1.68 | 0.42 | 0.015 | 0.012 | 0.004 | 0.006 | 829 | 0.78 |
| | 47 | 0.37 | 0.49 | 0.70 | 1.27 | 5.11 | 2.54 | 1.02 | 0.014 | 0.010 | 0.003 | 0.002 | 898 | 0.75 |
| | 48 | 0.24 | 0.39 | 0.80 | 0.43 | 2.98 | 1.82 | 0.43 | 0.002 | 0.010 | 0.004 | 0.002 | 897 | 0.76 |
| | 49 | 0.41 | 0.39 | 0.61 | 2.22 | 2.87 | 0.10 | 0.05 | 0.016 | 0.010 | 0.003 | 0.002 | 798 | 0.75 |
| | 50 | 0.23 | 0.09 | 0.15 | 0.35 | 1.58 | 0.77 | 0.05 | 0.014 | 0.012 | 0.003 | 0.002 | 837 | 0.78 |
| | 51 | 0.52 | 2.10 | 1.32 | 2.44 | 5.32 | 2.32 | 0.62 | 0.015 | 0.008 | 0.002 | 0.003 | 912 | 0.77 |
| | 52 | 0.53 | 0.30 | 0.83 | 1.72 | 0.85 | 0.33 | 0.01 | 0.00 | 0.008 | 0.004 | 0.002 | 784 | 0.98 |
| | 53 | 0.37 | 1.02 | 0.38 | 0.01 | 5.01 | 1.31 | 0.98 | 0.005 | 0.007 | 0.007 | 0.001 | 908 | 0.97 |

Thereafter, the blanks were tempered at 550–640° C. and then subjected to fracture toughness testing and high temperature strength testing. The fracture toughness test was performed according to ASTM E 399-83 and the fracture toughness values were calculated. The high temperature strength test was carried out according to JIS G 0567 at the test temperature of 600° C. using JIS 14A test specimens (6 mm in diameter) and the 0.2% proof stress values were measured.

Among the quenched and tempered blanks shown in Table 1 and Table 2, the blanks No. 1 to No. 18, No. 20, No. 21, No. 27, No. 33, No. 38 and No. 42 to No. 53 were selected and formed into press dies by machine working and electric-discharge machining. Using these press dies, forging was carried out using SCM 440 defined in JIS G 4105, as the work material, and the life (number of forgings) of each die was examined. The results thus obtained are shown in Table 3 and Table 4.

TABLE 3

| Example | No. | Fracture Toughness (MPa · $m^{1/2}$) | 0.2% proof stress at 600° C. (MPa) | Die life (No. of forgings) | Condition of damage |
|---|---|---|---|---|---|
| This | 1 | 84.6 | 672 | 11948 | Wear |
| Invention | 2 | 82.5 | 604 | 10160 | Wear |
| | 3 | 77.6 | 662 | 12380 | Wear |
| | 4 | 90.4 | 620 | 12153 | Wear |
| | 5 | 79.7 | 641 | 12789 | Wear |
| | 6 | 81.3 | 662 | 10527 | Wear |

TABLE 3-continued

| Example | No. | Fracture Toughness (MPa · $m^{1/2}$) | 0.2% proof stress at 600° C. (MPa) | Die life (No. of forgings) | Condition of damage |
|---|---|---|---|---|---|
| | 7 | 87.4 | 640 | 11632 | Wear |
| | 8 | 78.2 | 638 | 12552 | Wear |
| | 9 | 79.1 | 647 | 11978 | Wear |
| | 10 | 77.9 | 645 | 12746 | Wear |
| | 11 | 78.6 | 653 | 11517 | Wear |
| | 12 | 89.6 | 605 | 10705 | Wear |
| | 13 | 88.4 | 649 | 11105 | Wear |
| | 14 | 88.5 | 626 | 12787 | Wear |
| | 15 | 77.9 | 635 | 12022 | Wear |
| | 16 | 80.9 | 650 | 11457 | Wear |
| | 17 | 79.1 | 666 | 11939 | Wear |
| | 18 | 78.5 | 657 | 12003 | Wear |
| | 19 | 79.7 | 686 | — | — |
| | 20 | 78.1 | 702 | 12098 | Wear |
| For | 21 | 94.2 | 418 | 12333 | Wear |
| comparison | 22 | 96.0 | 399 | — | — |
| | 23 | 91.6 | 446 | — | — |
| | 24 | 90.2 | 438 | — | — |
| | 25 | 44.6 | 744 | — | — |
| | 26 | 50.3 | 674 | — | — |
| | 27 | 43.3 | 724 | 5065 | Wear |
| | 28 | 41.5 | 706 | — | — |
| | 29 | 41.7 | 716 | — | — |
| | 30 | 58.6 | 661 | — | — |

TABLE 4

| Example | No. | Fracture Toughness (MPa · $m^{1/2}$) | 0.2% proof Stress at 600° C. (MPa) | Die life (No. of forgings) | Condition of damage |
|---|---|---|---|---|---|
| For | 31 | 41.8 | 596 | — | — |
| comparison | 32 | 46.6 | 639 | — | — |
| | 33 | 55.4 | 616 | 7944 | Wear |
| | 34 | 46.8 | 629 | — | — |
| | 35 | 61.7 | 468 | — | — |
| | 36 | 70.6 | 524 | — | — |
| | 37 | 85.0 | 461 | — | — |
| | 38 | 46.3 | 711 | 3782 | Crack |
| | 39 | 73.2 | 538 | — | — |
| | 40 | 28.8 | 690 | — | — |
| | 41 | 85.7 | 436 | — | — |
| | 42 | 37.8 | 646 | 2784 | Crack |

TABLE 4-continued

| Example | No. | Fracture Toughness (MPa · $m^{1/2}$) | 0.2% proof Stress at 600° C. (MPa) | Die life (No. of forgings) | Condition of damage |
|---|---|---|---|---|---|
| | 43 | 39.1 | 512 | 3263 | Crack |
| | 44 | 67.0 | 556 | 6417 | Wear |
| | 45 | 46.3 | 445 | 4400 | Crack |
| | 46 | 68.5 | 461 | 2754 | Crack |
| | 47 | 24.8 | 770 | 2554 | Crack |
| | 48 | 58.4 | 684 | 2872 | Crack |
| | 49 | 96.9 | 442 | 7449 | Wear |
| | 50 | 66.9 | 517 | 6442 | Wear |
| | 51 | 26.7 | 582 | 3699 | Crack |
| | 52 | 80.6 | 399 | 5906 | Wear |
| | 53 | 25.7 | 658 | 2209 | Crack |

Figure 5:
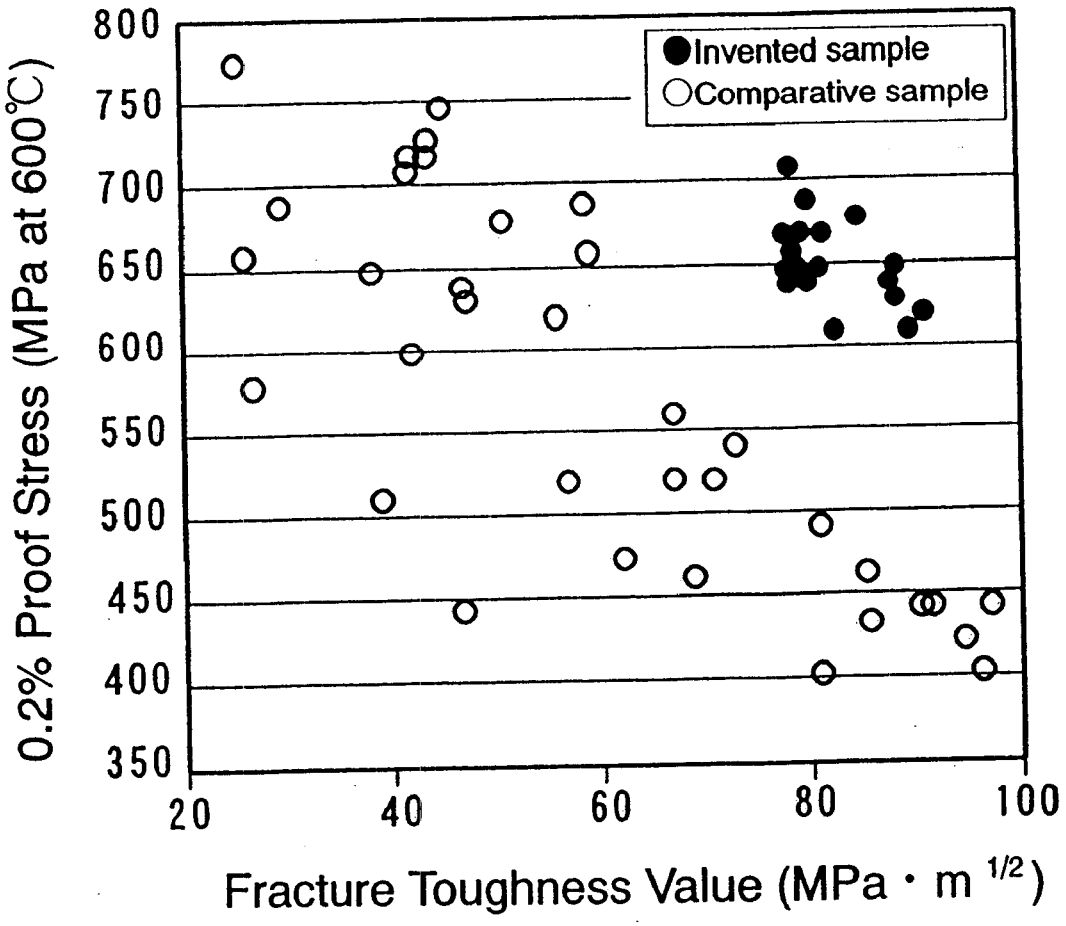
FIG. 5 is a graph showing the relationship between the fracture toughness and the high temperature strength (0.2% proof stress at 600° C.) as found in an example according to the present invention and in a comparative example.

Experience has taught that when the fracture toughness is not less than 77.5 MPa·$m^{1/2}$ and the 0.2% proof stress at 600° C. is not less than 539 MPa, the tool has a satisfactory long life. In each of Examples No. 1 to No. 20, which are examples of the present invention, shown in Table 3, the fracture toughness value and high temperature strength after tempering both satisfy the above requirements. On the contrary, in the comparative examples, No. 21 to No. 53, shown in Table 3 and Table 4, either one or both of the fracture toughness and high temperature strength are lower than the required values mentioned above. FIG. 5 is a graph showing the relation between fracture toughness and high temperature strength (0.2% proof stress at 600° C.) as found based on the data shown in Table 3 and Table 4, indicating that the examples according to the present invention are superior to the comparative examples.

The dies according to the invention are all longer in life than the dies of the comparative examples.

EXAMPLE 2

Steels having the chemical compositions shown in Table 5 and Table 6 were produced by melting in an electric furnace and then quenched in the same manner as in Example 1, and the hardness index values K were determined. The results are shown in Table 5 and Table 6, together with the $A_{c3}$ transformation points.

TABLE 5

| Example | No. | Chemical composition (% by weight) Balance: Fe and impurities | | | | | | | | | | | $A_{c3}$ Transformation point (° C.) | Hardness index K |
|---|---|---|---|---|---|---|---|---|---|---|---|---|---|---|
| | | C | Si | Mn | Ni | Cr | Mo | V | Al | N | P | S | | |
| This | 101 | 0.49 | 0.22 | 0.82 | 1.80 | 1.52 | 0.58 | 0.16 | 0.007 | 0.006 | 0.001 | 0.002 | 790 | 0.30 |
| Invention | 102 | 0.50 | 0.31 | 0.79 | 1.78 | 1.50 | 0.63 | 0.14 | 0.006 | 0.006 | 0.001 | 0.002 | 796 | 0.48 |
| | 103 | 0.51 | 0.46 | 0.80 | 1.83 | 1.51 | 0.60 | 0.12 | 0.008 | 0.009 | 0.002 | 0.001 | 806 | 0.78 |
| | 104 | 0.48 | 0.77 | 0.81 | 1.82 | 1.52 | 0.57 | 0.13 | 0.007 | 0.006 | 0.001 | 0.001 | 840 | 0.55 |
| | 105 | 0.49 | 1.03 | 0.79 | 1.77 | 1.53 | 0.62 | 0.12 | 0.008 | 0.007 | 0.002 | 0.002 | 863 | 0.50 |
| | 106 | 0.50 | 1.20 | 0.79 | 1.81 | 1.49 | 0.59 | 0.15 | 0.006 | 0.008 | 0.001 | 0.003 | 877 | 0.94 |
| For | 107 | 0.49 | 0.22 | 0.82 | 1.80 | 1.52 | 0.58 | 0.16 | 0.007 | 0.006 | 0.001 | 0.002 | 790 | 1.00 |
| comparison | 108 | 0.50 | 0.31 | 0.79 | 1.78 | 1.50 | 0.63 | 0.14 | 0.006 | 0.006 | 0.001 | 0.001 | 796 | 1.00 |
| | 109 | 0.51 | 0.46 | 0.80 | 1.83 | 1.51 | 0.60 | 0.12 | 0.008 | 0.009 | 0.002 | 0.001 | 806 | 1.00 |
| | 110 | 0.48 | 0.77 | 0.81 | 1.82 | 1.52 | 0.57 | 0.13 | 0.007 | 0.006 | 0.001 | 0.001 | 840 | 1.00 |
| | 111 | 0.49 | 1.03 | 0.79 | 1.77 | 1.53 | 0.62 | 0.12 | 0.008 | 0.007 | 0.002 | 0.002 | 863 | 1.00 |
| | 112 | 0.50 | 1.20 | 0.79 | 1.81 | 1.49 | 0.59 | 0.15 | 0.008 | 0.008 | 0.001 | 0.003 | 877 | 1.00 |
| | 113 | 0.49 | 0.22 | 0.82 | 1.80 | 1.52 | 0.58 | 0.16 | 0.007 | 0.006 | 0.001 | 0.002 | 790 | 0 |
| | 114 | 0.50 | 0.31 | 0.79 | 1.78 | 1.50 | 0.63 | 0.14 | 0.006 | 0.006 | 0.001 | 0.002 | 796 | 0 |
| | 115 | 0.51 | 0.46 | 0.80 | 1.83 | 1.51 | 0.60 | 0.12 | 0.008 | 0.009 | 0.002 | 0.001 | 806 | 0 |
| | 116 | 0.48 | 0.77 | 0.81 | 1.82 | 1.52 | 0.57 | 0.13 | 0.007 | 0.006 | 0.001 | 0.001 | 840 | 0 |
| | 117 | 0.49 | 1.03 | 0.79 | 1.77 | 1.53 | 0.62 | 0.12 | 0.008 | 0.007 | 0.002 | 0.002 | 863 | 0 |
| | 118 | 0.50 | 1.20 | 0.79 | 1.81 | 1.49 | 0.59 | 0.15 | 0.006 | 0.008 | 0.001 | 0.003 | 877 | 0 |

TABLE 5-continued

| Example | No. | Chemical composition (% by weight) Balance: Fe and impurities | | | | | | | | | | | $A_{c3}$ Transformation | |
|---|---|---|---|---|---|---|---|---|---|---|---|---|---|---|
| | | C | Si | Mn | Ni | Cr | Mo | V | Al | N | P | S | point (° C.) | Hardness index K |
| | 119 | 0.32 | 0.25 | 0.77 | 1.81 | 1.47 | 0.63 | 0.14 | 0.007 | 0.008 | 0.003 | 0.003 | 818 | 0.98 |
| | 120 | 0.63 | 0.64 | 0.80 | 1.83 | 1.51 | 0.57 | 0.16 | 0.009 | 0.006 | 0.002 | 0.001 | 805 | 0.96 |

TABLE 6

| Example | No. | Chemical composition (% by weight) Balance: Fe and impurities | | | | | | | | | | | $A_{c3}$ Transformation | |
|---|---|---|---|---|---|---|---|---|---|---|---|---|---|---|
| | | C | Si | Mn | Ni | Cr | Mo | V | Al | N | P | S | point (° C.) | Hardness index K |
| For comparison | 121 | 0.48 | 0.05 | 0.82 | 1.82 | 1.47 | 0.61 | 0.15 | 0.007 | 0.009 | 0.003 | 0.002 | 775 | 1.00 |
| | 122 | 0.52 | 0.10 | 0.81 | 1.83 | 1.50 | 0.61 | 0.15 | 0.009 | 0.008 | 0.001 | 0.002 | 773 | 0.98 |
| | 123 | 0.52 | 1.52 | 0.82 | 1.79 | 1.48 | 0.61 | 0.16 | 0.009 | 0.006 | 0.002 | 0.001 | 905 | 0.99 |
| | 124 | 0.51 | 1.14 | 0.15 | 1.78 | 1.49 | 0.60 | 0.15 | 0.006 | 0.008 | 0.001 | 0.003 | 862 | 0.96 |
| | 125 | 0.52 | 1.20 | 1.80 | 1.81 | 1.52 | 0.61 | 0.12 | 0.009 | 0.008 | 0.002 | 0.002 | 887 | 0.96 |
| | 126 | 0.47 | 0.91 | 0.80 | 0.47 | 1.53 | 0.59 | 0.14 | 0.009 | 0.006 | 0.002 | 0.003 | 884 | 0.97 |
| | 127 | 0.49 | 0.33 | 0.82 | 2.79 | 1.50 | 0.61 | 0.15 | 0.006 | 0.007 | 0.002 | 0.002 | 778 | 0.98 |
| | 128 | 0.47 | 1.20 | 0.81 | 1.83 | 0.50 | 0.59 | 0.13 | 0.007 | 0.009 | 0.002 | 0.003 | 880 | 0.99 |
| | 129 | 0.50 | 0.32 | 0.82 | 1.79 | 3.25 | 0.58 | 0.12 | 0.008 | 0.009 | 0.003 | 0.003 | 797 | 0.98 |
| | 130 | 0.50 | 0.80 | 0.15 | 1.78 | 1.49 | 0.12 | 0.15 | 0.008 | 0.009 | 0.002 | 0.003 | 827 | 1.00 |
| | 131 | 0.52 | 0.78 | 1.80 | 1.81 | 1.52 | 3.00 | 0.17 | 0.007 | 0.008 | 0.002 | 0.001 | 874 | 0.99 |
| | 132 | 0.50 | 0.82 | 0.80 | 0.50 | 1.53 | 0.59 | 0.10 | 0.009 | 0.008 | 0.002 | 0.003 | 869 | 0.97 |
| | 133 | 0.52 | 0.55 | 0.82 | 3.25 | 1.50 | 0.61 | 0.80 | 0.007 | 0.007 | 0.002 | 0.003 | 810 | 0.96 |
| | 134 | 0.50 | 0.95 | 0.81 | 1.83 | 0.12 | 0.59 | 0.13 | 0.003 | 0.006 | 0.002 | 0.002 | 852 | 0.18 |
| | 135 | 0.52 | 0.35 | 0.82 | 1.79 | 3.00 | 0.58 | 0.12 | 0.100 | 0.006 | 0.001 | 0.003 | 797 | 0.12 |
| | 136 | 0.49 | 0.30 | 0.82 | 1.78 | 1.50 | 0.60 | 0.15 | 0.006 | 0.050 | 0.003 | 0.001 | 797 | 0.07 |
| | 137 | 0.51 | 0.95 | 0.83 | 1.77 | 1.50 | 0.58 | 0.17 | 0.006 | 0.008 | 0.052 | 0.003 | 855 | 0.05 |
| | 138 | 0.49 | 0.63 | 0.78 | 1.80 | 1.50 | 0.61 | 0.12 | 0.008 | 0.007 | 0.002 | 0.049 | 825 | 0.05 |

Then, after tempering at 550–640° C., the fracture toughness test, high temperature strength test and machinability test were conducted. The fracture toughness test and high temperature strength test were carried out in the same manner as in Example 1. In the machinability test, the samples were subjected to milling under the conditions given below and the cutting lengths until termination of the cutting tool life were measured.

Tool: A PVD-coated cemented carbide tool prepared from the material HW-K20 defined in JIS B 4053;

Cutting speed, V: 50 m/min.;

Feed, f: 0.18 mm/cutting edge;

Depth of cut, d: 3.0 mm.

Among the quenched and tempered blanks shown in Table 5 and Table 6, No. 101 to 106, No. 112, No. 113, No. 119, Mo. 124, No. 126, No. 133 and No. 134 were chosen and hammer dies were manufactured therefrom by machine working and electric-discharge machining. Using these hammer dies, forging was carried out using SCM 440 defined in JIS G 4105 as the work material, and the life (number of forgings) of each die was examined. The results thus obtained are shown in Table 7 and Table 8.

TABLE 7

| Example | No. | Fracture toughness (MPa · $m^{1/2}$) | 0.2% proof stress at 600° C. (MPa) | Machinability (m) | Die life (No. of forgings) | Condition of damage |
|---|---|---|---|---|---|---|
| This invention | 101 | 110.1 | 601 | 1.3 | 16339 | Wear |
| | 102 | 111.6 | 595 | 1.3 | 15299 | Wear |
| | 103 | 101.4 | 584 | 2.5 | 15475 | Wear |
| | 104 | 102.6 | 568 | 2.6 | 15871 | Wear |
| | 105 | 91.8 | 564 | 2.7 | 15551 | Wear |
| | 106 | 79.7 | 549 | 3.1 | 15160 | Wear |
| For comparison | 107 | 143.3 | 512 | 1.0 | — | — |
| | 108 | 132.1 | 501 | 1.5 | — | — |
| | 109 | 136.4 | 472 | 2.2 | — | — |
| | 110 | 124.0 | 453 | 2.7 | — | — |
| | 111 | 114.7 | 447 | 3.1 | — | — |
| | 112 | 104.2 | 431 | 3.0 | 8231 | Wear |
| | 113 | 22.3 | 697 | 1.1 | 3025 | Crack |
| | 114 | 20.5 | 666 | 1.2 | — | — |
| | 115 | 24.8 | 649 | 1.9 | — | — |
| | 116 | 24.8 | 621 | 2.5 | — | — |
| | 117 | 26.0 | 613 | 2.8 | — | — |
| | 118 | 20.5 | 601 | 3.1 | — | — |
| | 119 | 73.5 | 490 | 1.1 | 9270 | Wear |
| | 120 | 134.3 | 461 | 1.9 | — | — |

TABLE 8

| Example | No. | Fracture toughness (MPa · $m^{1/2}$) | 0.2% proof stress at 600° C. (MPa) | Machinability (m) | Die life (No. of forgings) | Condition of damage |
|---|---|---|---|---|---|---|
| For com-parison | 121 | 152.6 | 538 | 0.3 | — | — |
| | 122 | 145.1 | 529 | 0.5 | — | — |
| | 123 | 85.9 | 414 | 3.1 | — | — |
| | 124 | 93.0 | 412 | 2.9 | 6397 | Wear |
| | 125 | 73.5 | 421 | 3.1 | — | — |
| | 126 | 69.5 | 441 | 2.5 | 7150 | Wear |
| | 127 | 131.2 | 500 | 0.9 | — | — |
| | 128 | 76.6 | 412 | 3.2 | — | — |
| | 129 | 115.4 | 451 | 0.9 | — | — |
| | 130 | 127.5 | 441 | 2.7 | — | — |
| | 131 | 38.8 | 500 | 0.5 | — | — |
| | 132 | 132.1 | 510 | 2.6 | — | — |
| | 133 | 39.7 | 529 | 0.3 | 5328 | Wear, Crack |
| | 134 | 27.6 | 637 | 2.7 | 4329 | Wear |
| | 135 | 18.3 | 510 | 0.5 | — | — |
| | 136 | 27.3 | 686 | 1.3 | — | — |
| | 137 | 18.0 | 519 | 2.6 | — | — |
| | 138 | 14.0 | 500 | 2.0 | — | — |

Experience has taught that when the fracture toughness is not less than 77.5 MPa·$m^{1/2}$ and the 0.2% proof stress at 600° C. is not less than 539 MPa, the tool has a satisfactory long life and that when the cutting length is not less than 1 m, the machinability is satisfactory. In each of Examples No. 101 to No. 106, which are examples of the present invention, shown in Table 7, the fracture toughness value, high temperature strength and machinability all satisfy the above requirements. On the contrary, in the comparative examples, No. 107 to No. 138, shown in Table 7 and Table 8, at least one of the fracture toughness, high temperature strength and machinability is lower than the relevant required value mentioned above.

The dies according to the invention are all longer in life than the dies of the comparative examples.

Increasing the Si content is effective in improving the machinability. According to the prior art technology, however, an increase in Si content results in decreases in fracture toughness and high temperature strength. On the contrary, the tool steel produced by the method according to the present invention is endowed with a mixed structure comprising the bainite and martensite phases as the structure after quenching by restricting the hardness index K to a specific range, which resulting in that the decreases in fracture toughness and high temperature strength can be prevented. That is, the tool steel of the present invention is superior in high temperature strength and fracture toughness and also in machinability to the conventional tool steels. According to the manufacturing method of the invention, long-lived tools can be manufactured. Therefore, the tool steel of the present invention is suitable for use in working tools such as the dies for a hot forging.

What is claimed is:

1. A method of producing a tool steel comprises; preparing a steel having a chemical composition such that it contains, by mass percent, C: 0.25 to 0.45%, Si: 0.10 to 1.00%, Mn: 0.20 to 1.00%, Ni: 0.50 to 2.00%, Cr: 2.80 to 4.20%, Mo: 1.00 to 2.00%, V: 0.10 to 1.00% and Al: 0.005 to 0.10%, with the balance being Fe and impurities, and that the content of P among the impurities is not more than 0.015%, that of S is not more than 0.005% and that of N is not more than 0.015%; quenching the steel from a temperature of 900 to 1050° C. to obtain a hardness H such that the hardness index K defined below by the formula (1) becomes between 0.20 to 0.95; and then tempering the quenched steel at a temperature of 550 to 640° C.;

$$K=(H-H2)/(H1-H2) \quad (1)$$

where

H1: Vickers hardness found on a standard sample with 10 mm thickness which is heated to a temperature of the $Ac_3$ transformation point plus 50° C., and quenched into water;

H2: Vickers hardness found on a standard sample with 10 mm thickness which is heated to a temperature of the $Ac_3$ transformation point plus 50° C., and cooled to room temperature over 20 hours.

2. A method of producing a tool steel comprises: preparing a steel having a chemical composition such that it contains, by mass percent, C: 0.40 to 0.60%, Si: more than 0.20% to 1.20%, Mn: 0.20 to 1.50%, Ni: 1.00 to 2.00%, Cr: 1.00 to 2.70%, Mo: 0.30 to 2.00%, V: more than 0.10% but less than 0.80% and Al: 0.005% to less than 0.10%, with the balance being Fe and impurities, and that the content of P among the impurities is not more than 0.015%, that of S is not more than 0.005% and that of N is not more than 0.015%; quenching the steel from a temperature of 900 to 1050° C. to obtain a hardness H such that the hardness index K defined below by the formula (1) becomes between 0.20 to 0.95; and then tempering the quenched steel at a temperature of 550 to 640° C.;

$$K=(H-H2)/(H1-H2) \quad (1)$$

where

H1: Vickers hardness found on a standard sample with 10 mm thickness which is heated to a temperature of the $Ac_3$ transformation point plus 50° C., and quenched into water;

H2: Vickers hardness found on a standard sample with 10 mm thickness which is heated to a temperature of the $Ac_3$ transformation point plus 50° C., and cooled to room temperature over 20 hours.

3. A method of manufacturing a tool comprises; preparing a steel having a chemical composition such that it contains, by mass percent, C: 0.25 to 0.45%, Si: 0.10 to 1.00%, Mn: 0.20 to 1.00%, Ni: 0.50 to 2.00%, Cr: 2.80 to 4.20%, Mo:

1.00 to 2.00%, V: 0.10 to 1.00% and Al: 0.005 to 0.10%, with the balance being Fe and impurities, and that the content of P among the impurities is not more than 0.015%, that of S is not more than 0.005% and that of N is not more than 0.015%; forming the steel into a tool shape; quenching the tool shape from a temperature of 900 to 1050° C. to obtain a hardness H such that the hardness index K defined below by the formula (1) becomes between 0.20 to 0.95 and then tempering the quenched tool shape at a temperature of 550 to 640° C.;

$$K=(H-H2)/(H1-H2) \quad (1)$$

where

H1: Vickers hardness found on a standard sample with 10 mm thickness which is heated to a temperature of the $Ac_3$ transformation point plus 50° C., and quenched into water;

H2: Vickers hardness found on a standard sample with 10 mm thickness which is heated to a temperature of the $Ac_3$ transformation point plus 50° C., and cooled to room temperature over 20 hours.

4. A method of manufacturing a tool comprises; preparing a steel having a chemical composition such that it contains, by mass percent, C: 0.40 to 0.60%, Si: more than 0.20% to 1.20%, Mn: 0.20 to 1.50%, Ni: 1.00 to 2.00%, Cr: 1.00 to 2.70%, Mo: 0.30 to 2.00%, V: more than 0.10% but less than 0.80% and Al: 0.005% to less than 0.10%, with the balance being Fe and impurities, and that the content of P among the impurities is not more than 0.015%, that of S is not more than 0.005% and that of N is not more than 0.015%; forming the steel into a tool shape; quenching the tool shape from a temperature of 900 to 1050° C. to obtain a hardness H such that the hardness index K defined below by the formula (1) becomes between 0.20 to 0.95 and then tempering the quenched tool shape at a temperature of 550 to 640° C.:

$$K=(H-H2)/(H1-H2) \quad (1)$$

where

H1: Vickers hardness found on a standard sample with 10 mm thickness which is heated to a temperature of the $Ac_3$ transformation point plus 50° C., and quenched into water;

H2: Vickers hardness found on a standard sample with 10 mm thickness which is heated to a temperature of the $Ac_3$ transformation point plus 50° C., and cooled to room temperature over 20 hours.

5. A method of manufacturing a tool comprises; preparing a steel having a chemical composition such that it contains, by mass percent, C: 0.25 to 0.45%, Si: 0.10 to 1.00%, Mn: 0.20 to 1.00%, Ni: 0.50 to 2.00%, Cr: 2.80 to 4.20%, Mo: 1.00 to 2.00%, V: 0.10 to 1.00% and Al: 0.005 to 0.10%, with the balance being Fe and impurities, and that the content of P among the impurities is not more than 0.015%, that of S is not more than 0.005% and that of N is not more than 0.015%; quenching the steel from a temperature of 900 to 1050° C. to obtain a hardness H such that the hardness index K defined below by the formula (1) becomes between 0.20 to 0.95; tempering the quenched steel at a temperature of 550 to 640° C.; and then forming the steel into a tool shape:

$$K=(H-H2)/(H1-H2) \quad (1)$$

where

H1: Vickers hardness found on a standard sample with 10 mm thickness which is heated to a temperature of the $Ac_3$ transformation point plus 50° C., and quenched into water;

H2: Vickers hardness found on a standard sample with 10 mm thickness which is heated to a temperature of the $Ac_3$ transformation point plus 50° C., and cooled to room temperature over 20 hours.

6. A method of manufacturing a tool comprises; preparing a steel having a chemical composition such that it contains, by mass percent, C: 0.40 to 0.60%, Si: more than 0.20% to 1.20%, Mn: 0.20 to 1.50%, Ni: 1.00 to 2.00%, Cr: 1.00 to 2.70%, Mo: 0.30 to 2.00%, V: more than 0.10% but less than 0.80% and Al: 0.005% to less than 0.10%, with the balance being Fe and impurities, and that the content of P among the impurities is not more than 0.015%, that of S is not more than 0.005% and that of N is not more than 0.015%; quenching the steel from a temperature of 900 to 1050° C. to obtain a hardness H such that the hardness index K defined below by the formula (1) becomes between 0.20 to 0.95; tempering the quenched steel at a temperature of 550 to 640° C.; and then forming the tempered steel into a tool shape:

$$K=(H-H2)/(H1-H2) \quad (1)$$

where

H1: Vickers hardness found on a standard sample with 10 mm thickness which is heated to a temperature of the $Ac_3$ transformation point plus 50° C., and quenched into water;

H2: Vickers hardness found on a standard sample with 10 mm thickness which is heated to a temperature of the $Ac_3$ transformation point plus 50° C., and cooled to room temperature over 20 hours.

* * * * *